US011282624B2

(12) United States Patent
Lu et al.

(10) Patent No.: US 11,282,624 B2
(45) Date of Patent: Mar. 22, 2022

(54) RARE EARTH BARIUM COPPER OXIDE MAGNET COILS AND METHODS

(71) Applicant: The Florida State University Research Foundation, Inc., Tallahassee, FL (US)

(72) Inventors: Jun Lu, Tallahassee, FL (US); Jeremy Levitan, Tallahassee, FL (US)

(73) Assignee: THE FLORIDA STATE UNIVERSITY RESEARCH FOUNDATION, INC., Tallahassee, FL (US)

( * ) Notice: Subject to any disclaimer, the term of this patent is extended or adjusted under 35 U.S.C. 154(b) by 137 days.

(21) Appl. No.: 16/283,187

(22) Filed: Feb. 22, 2019

(65) Prior Publication Data

US 2019/0267172 A1 Aug. 29, 2019

Related U.S. Application Data

(60) Provisional application No. 62/634,231, filed on Feb. 23, 2018.

(51) Int. Cl.
*H01F 6/06* (2006.01)
*H01F 41/061* (2016.01)
(Continued)

(52) U.S. Cl.
CPC ..... *H01F 6/06* (2013.01); *H01F 1/342* (2013.01); *H01F 41/048* (2013.01);
(Continued)

(58) Field of Classification Search
CPC ..... H01F 6/06; H01F 41/063
See application file for complete search history.

(56) References Cited

U.S. PATENT DOCUMENTS 5,801,124 A 9/1998 Gamble et al.
10,861,626 B2 * 12/2020 Kim ..... H01F 6/00
(Continued)

FOREIGN PATENT DOCUMENTS

EP 2958115 A1 12/2015

OTHER PUBLICATIONS

International Search Report and the Written Opinion of PCT/US2019/019225 dated Aug. 13, 2019.
(Continued)

*Primary Examiner* — Alexander Talpalatski
(74) *Attorney, Agent, or Firm* — Eversheds Sutherland (US) LLP

(57) ABSTRACT

Tapes and coils for superconducting magnets are provided, along with methods of making the tapes and coils. In one embodiment, the coil includes a rare earth barium copper oxide (REBCO) superconducting tape; and a thin resistive layer of copper oxide, Cr, Ni, or Ni—P substantially coated onto the REBCO superconducting tape, wherein the coated REBCO superconducting tape is wound into a coil form. In another embodiment, the coil includes at least two REBCO superconducting tapes; and a stainless steel tape interlayer disposed between the at least two REBCO superconducting tapes, wherein the stainless steel tape comprises a plating layer of nickel or copper, and wherein the at least two REBCO superconducting tapes together with the stainless steel tape interlayer are wound into a coil form.

26 Claims, 8 Drawing Sheets

(51) Int. Cl.

| | |
|---|---|
| ***H01F 1/34*** | (2006.01) |
| ***H01F 41/04*** | (2006.01) |
| ***H01F 41/063*** | (2016.01) |
| *H01F 6/02* | (2006.01) |

(52) U.S. Cl.
CPC ..... *H01F 41/061* (2016.01); *H01F 41/063* (2016.01); *H01F 6/02* (2013.01)

(56) References Cited

U.S. PATENT DOCUMENTS

| | | | | |
|---|---|---|---|---|
| 2015/0024942 | A1* | 1/2015 | Hayase | H01L 39/143 505/230 |
| 2018/0350494 | A1* | 12/2018 | Iwai | H01F 6/06 |
| 2019/0074118 | A1* | 3/2019 | Kim | H01F 6/02 |

OTHER PUBLICATIONS

Tanaka, K. et al., Development of the Current Bypassing Methods into the Transverse Direction in Non-Insulation HTS Coils, Physics Procedia, Jun. 20, 2015, pp. 229-232, vol. 65.

Hahn, S. et al., HTS Pancake Coils Without Turn-to-Turn Insulation, IEEE Transactions on Applied Superconductivity, Jun. 2011, pp. 1592-1595, vol. 21, No. 3.

Lecrevisse, T. et al., A (RE)BCO Pancake Winding With Metal-as-Insulation, IEEE Transactions on Applied Superconductivity, Apr. 2016, 5 pages, vol. 26, No. 3.

Gupta, R. et al., High-Field Solenoid Development for Axion Dark Matter Search at CAPP/IBS, IEEE Transactions on Applied Superconductivity, Jun. 2016, 5 pages, vol. 26, No. 4.

Lu, J. et al., Contact Resistance Between Two REBCO Tapes Under Load and Load Cycles, Superconductor Science and Technology, Feb. 2017, 9 pages, vol. 30., No. 4.

Noguchi, S. et al., Numerical Investigation of Metal Insulation Technique on Turn-to-Turn Contact Resistance of REBCO Pancake Coils, IEEE Transactions on Applied Superconductivity, Jun. 2017, 5 pages, vol. 27, No. 4.

Wang, Y. et al., Analysis and Comparison Between No-Insulation and Metallic Insulation REBCO Magnet for the Engineering Design of a 1-MW DC Induction Heater, IEEE Transactions on Applied Superconductivity, Jun. 2017, 5 pages, vol. 27, No. 4.

* cited by examiner

RARE EARTH BARIUM COPPER OXIDE MAGNET COILS AND METHODS

CROSS REFERENCE TO RELATED APPLICATIONS

This application claims priority to U.S. Provisional Patent Application No. 62/634,231, filed Feb. 23, 2018, which is incorporated herein in its entirety.

STATEMENT REGARDING FEDERALLY SPONSORED RESEARCH AND DEVELOPMENT

This invention was made with government support under Grant No. DMR-0084173 awarded by the National Science Foundation. The government has certain rights in the invention.

FIELD OF THE DISCLOSURE

This disclosure relates generally to magnets and magnetic compositions and structures, and more particularly to Rare Earth-Barium-Copper Oxide (REBCO) magnets, and methods of making the same.

BACKGROUND

No insulation (NI) REBCO pancake magnet coils have several advantages over conventional insulated coils. For example, due to low turn-to-turn electrical resistance, when magnet quench happens in a NI REBCO coil, the quench current automatically bypasses the normal zone, and a hot spot is avoided. This self-quench-protection ability eliminates the need for a quench detection and protection system that can be very challenging and costly in a large high field REBCO magnet. Consequently, an NI REBCO coil is very stable, which allows for a thinner copper stabilizer on the REBCO conductor. With the thinner stabilizer and the elimination of insulation, the NI REBCO provides a very high engineering current density and high mechanical strength. These suggest that this technology enables very compact magnets to reach a very high magnetic field.

There are, however, drawbacks in the current state of the NI REBCO coil technology. For example, NI coils typically have a long charging delay time, as well as high field ramp losses. This is a concern especially for cryo-cooled magnets, where the cooling power is limited. These issues are directly related to low turn-to-turn contact resistivity ($R_c$), which is defined as contact resistance multiplied by contact area, and can be mitigated somewhat by increasing $R_c$. On the other hand, very high $R_c$ compromises the turn-to-turn current transfer capability therefore jeopardizes the coil's self-protection ability.

Accordingly, improved coils for superconducting magnets and methods of making the same are needed.

BRIEF SUMMARY

In one aspect, improved rare earth barium copper oxide (REBCO) tapes and coils are provided for superconducting magnets. In one embodiment, a coil for a superconducting magnet includes a REBCO superconducting tape; and a thin resistive layer of copper oxide, Cr, Ni, or Ni—P substantially coated onto the REBCO superconducting tape, wherein the coated REBCO superconducting tape is wound into a coil form. In another embodiment, a coil for superconducting magnet includes at least two REBCO superconducting tapes; and a stainless steel tape interlayer disposed between the at least two REBCO superconducting tapes, wherein the stainless steel tape comprises a plating layer of nickel or copper, and wherein the at least two REBCO superconducting tapes together with the stainless steel tape interlayer are wound into a coil form. In some preferred implementations, the coils are no-insulation coils, which may be assembled into a pancake magnet coil.

In another aspect, methods are provided for making improved REBCO tapes and coils for superconducting magnets. In one embodiment, the method for making a coil for a superconducting magnet includes: providing a REBCO superconducting tape; forming a thin resistive layer of copper oxide, Cr, Ni, or Ni—P substantially coating the REBCO superconducting tape; and then winding the coated REBCO tape into a coil. In another embodiment, the method for making a coil for a superconducting magnet includes: plating a stainless steel tape with nickel or copper to form a plated stainless steel tape; positioning the plated stainless steel tape between two REBCO superconducting tapes; and winding the two REBCO superconducting tapes and the stainless steel tape into a coil.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

New and improved REBCO superconducting tapes and coils for superconducting magnets, and methods for their manufacture have been developed. In particular, the long magnet charging time and high field-ramp-losses of NI REBCO magnets may be mitigated by controlling the turn-to-turn contact resistivity ($R_c$). In various embodiments described herein, this may be accomplished with selected coatings and/or interlayers. In some embodiments, a REBCO conductor tape is coated with various resistive thin films. In some other embodiments, a stainless steel tape is used as interlayer which is also coated with different metallic films. In some embodiments, a metallic co-winding interlayer is used to provide an insulation effect. In addition, without intending to be bound by any particular theory, it is believed that the conductor with graded $R_c$ is used to reduce the ramp loss, as well as to improve stability and recovery speed after a quench in large NI REBCO magnets.

In some embodiments, $R_c$ can be optimized to achieve a relatively short charging delay time and low ramp losses without jeopardizing the coil's self-protection ability. Many theoretical analyses have been done to predict the quench behaviors of NI magnet coils and the effect of $R_c$. Surprisingly, however, these studies suggest that $R_c$ values ranging from 1,000 to 100,000 $\mu\Omega\text{-cm}^2$ might be suitable, which is significantly higher than the about 70 $\mu\Omega\text{-cm}^2$ in NI coils according to embodiments of the present disclosure.

Without intending to by any particular theory, it is believed that $R_c$ is a critical parameter in the development of NI coil technology.

As used herein, "substantially coated" is used broadly to mean that all or a majority of at least one surface is coated with a substance, e.g., at least one side of a tape. For example, at least 50%, at least 60%, at least 70%, at least 80%, at least 90%, at least 95%, at least 99%, or any ranges therebetween, of the surface is coated with the substance.

As used herein, a "tape" is a long, thin, flexible strip of material, e.g., of a metal, as that term is understood in the art related to superconducting magnets.

Figure 14:
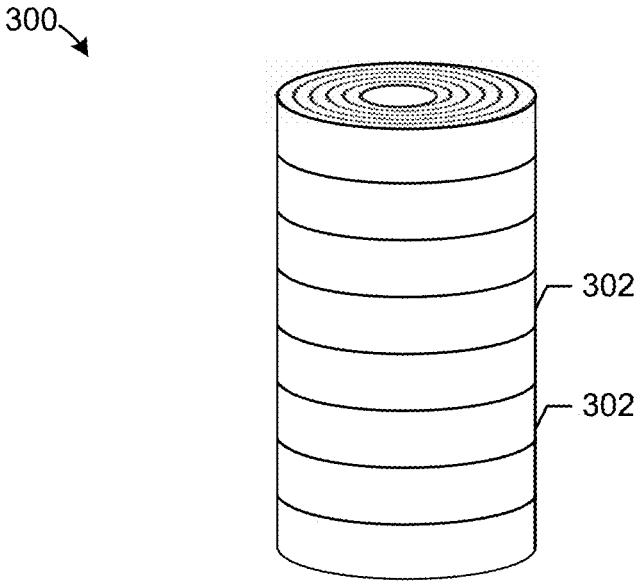
FIG. 14 is a perspective view of a magnet including a stack of a plurality of coils formed from modified REBCO tapes, according to some embodiments of the present disclosure.

FIG. 14 is a perspective view of a magnet 300 including a stack of a plurality of coils 302. The coils 302 may consist of the modified REBCO superconducting tape structures described herein. Other suitable configurations of the modified REBCO tapes and coils thereof may be used in other magnet structures or in other systems.

In various embodiments, modified REBCO superconducting tapes, and coils thereof, are provided. Two different general structures coils are described below.

I. Coated REBCO Tapes, Coils, and Methods

In some embodiments, the coil includes a REBCO superconducting tape that is substantially coated with a thin resistive layer of copper oxide, Cr, Ni, or Ni—P.

Figure 12:
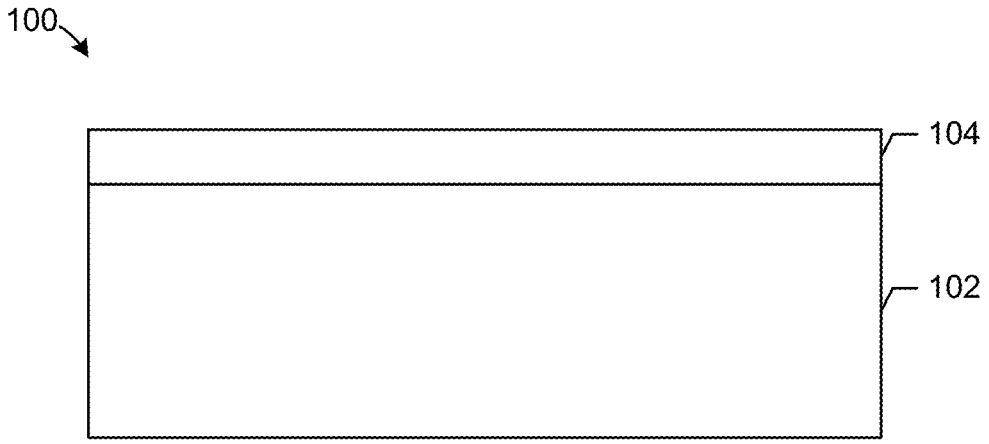
FIG. 12 is a cross-sectional view of a REBCO tape with a thin resistive layer, according to an embodiment of the present disclosure.

FIG. 12 shows, in a cross-sectional view, one embodiment of a coated REBCO superconducting tape 100 including a REBCO tape 102 with a thin resistive layer 104.

In some embodiments, the thin resistive layer has a thickness from about 100 nm to about 10 μm. For example, in various embodiments, the average thickness is about 100 nm, about 200 nm, about 300 nm, about 400 nm, about 500 nm, about 600 nm, about 700 nm, about 800 nm, about 900 nm, about 1 μm, about 1.1 μm, about 1.2 μm, about 1.3 μm, about 1.4 μm, about 1.5 μm, about 1.6 μm, about 1.7 μm, about 1.8 μm, about 1.9 μm, about 2 μm, about 3 μm, about 4 μm, about 5 μm, about 6 μm, about 7 μm, about 8 μm, about 9 μm, about 10 μm, or any ranges therebetween.

The coils may be made using various techniques. In some embodiments, a method of making a coil for a superconducting magnet includes the following steps: (i) providing a REBCO superconducting tape; (ii) forming a thin resistive layer of copper oxide, Cr, Ni, or Ni—P substantially coating the REBCO superconducting tape, to produce a coated REBCO tape; and then (iii) winding the coated REBCO tape into a coil. In some embodiments, the thin resistive layer of copper oxide, Cr, Ni, or Ni—P is substantially coated onto the REBCO superconducting tape by a plating process or by a physical vapor deposition (PVD) process. Plating and PVD processes are known in the art.

Figure 15:
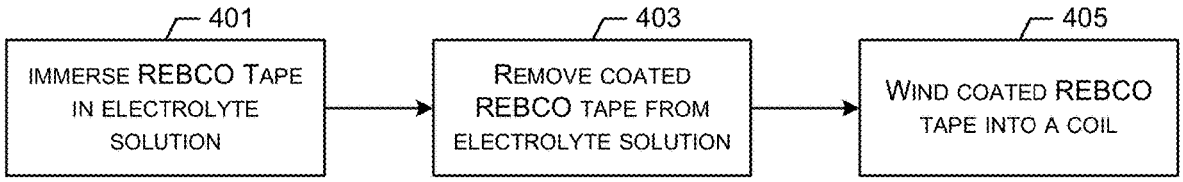
FIG. 15 is a process flow diagram of a method of making a coil for a superconducting magnet, according to some embodiments of the present disclosure.

FIG. 15 is a flow diagram of a plating method for making the tape structure shown in FIG. 12. This method includes a first step 401 of immersing a REBCO tape in an electrolyte solution, a second step 403 of removing the coated REBCO tape from the electrolyte solution, and a third step 405 of winding the coated REBCO tape into a coil. One skilled in the art in view of the description herein and the examples below can determine suitable plating conditions to achieve the desired coating composition, including selecting the appropriate electrolyte solutions, and plating times and temperatures. In some embodiments, the electrolyte solution is selected from an Ebonol C solution, a Caswell nickel solution, a Caswell nickel-phosphorous solution, a $Cr_2O_3$ and $H_2SO_4$ aqueous solution, and a $CuSO_4$ aqueous solution. Other suitable electrolyte solutions may be used. In some embodiments, immersing the REBCO superconducting tape in the electrolyte solution comprises immersing the REBCO superconducting tape for from about 10 seconds to about 60 seconds, for example about 10 seconds, about 20 seconds, about 30 seconds, about 40 seconds, about 50 seconds, about 60 seconds, or any ranges therebetween. Winding of the coated tape in step 405 may be carried out using conventional winding methods and equipment.

In some embodiments, the plated thin resistive layer of copper oxide, Cr, Ni, or Ni—P is about 1 μm thick.

In some other embodiments, a physical vapor deposition (PVD) process is used to coat the REBCO tapes. REBCO conductor manufacturers are typically equipped with PVD systems with reel-to-reel operation capabilities. Such systems could be adapted to particular processes described herein.

In some embodiments, the modified tape has a turn-to-turn contact resistivity ($R_c$) which is at least about 10 times higher than that of a comparative REBCO superconducting tape without a thin resistive layer of copper oxide, Cr, Ni, or Ni—P. For example, the turn-to-turn contact resistivity ($R_c$) may be about 10 times higher, about 20 times higher, about 30 times higher, about 40 times higher, about 50 times higher, about 60 times higher, about 70 times higher, about 80 times higher, about 100 times higher, about 200 times higher, about 300 times higher, about 400 times higher, about 500 times higher, about 600 times higher, about 700 times higher, about 800 times higher, about 900 times higher, about 1000 times higher, about 1100 times higher, about 1200 times higher, about 1300 times higher, about 1400 times higher, about 1500 times higher, or any ranges therebetween.

In some embodiments, the REBCO superconducting tape is coated with a resistive layer of copper oxide, and the coil further includes a stainless steel layer attached to the coated REBCO tape.

II. REBCO and Plated Stainless Steel Tapes, Coil, and Methods

In some embodiments, the coil includes at least two REBCO superconducting tapes and a stainless steel tape interlayer is disposed between the two REBCO superconducting tapes, wherein the stainless steel tape has a plating layer of nickel or copper. The at least two REBCO superconducting tapes, together with the stainless steel tape interlayer, are wound into a coil form.

Figure 13:
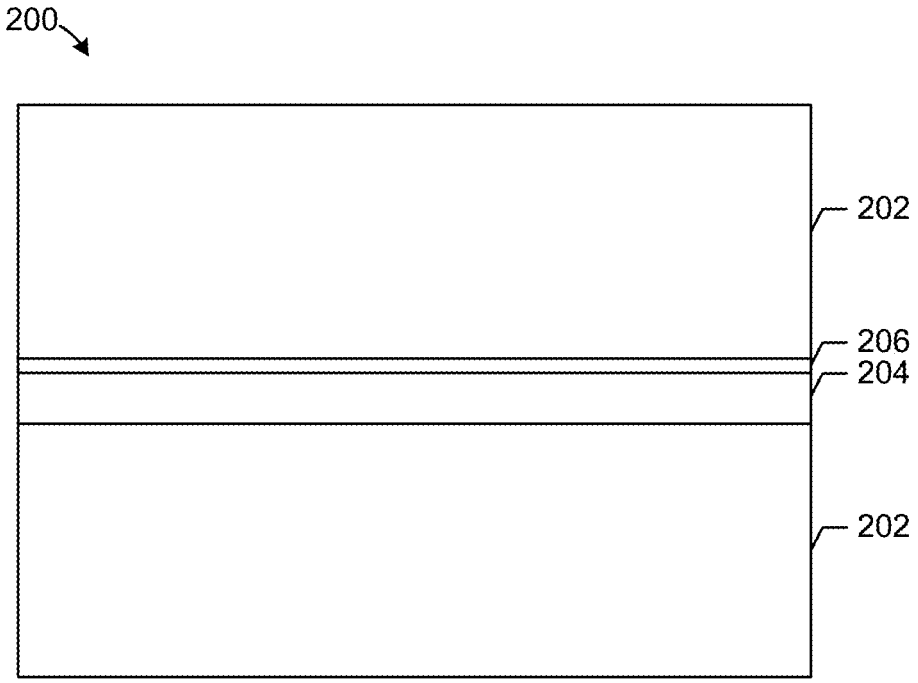
FIG. 13 is a cross-sectional view of a tape structure composes of two REBCO tapes with a plated stainless steel tape interlayer, according to an embodiment of the present disclosure.

FIG. 13 shows, in a cross-sectional view, one embodiment of the superconducting tape structure 200 that includes two REBCO superconducting tapes 202 between which a stainless steel tape 204 with a plating layer 206 of nickel or copper is interlaid.

In some embodiments, the steel tape is 316 stainless steel. In other embodiments, other grades of stainless steel may be used.

In some embodiments, the stainless steel tape has a thickness from about 10 μm to about 100 μm. For example, in various embodiments, the average thickness is about 10 μm thick, about 20 μm thick, about 30 μm thick, about 40 μm thick, about 50 μm thick, about 60 μm thick, about 70 μm thick, about 80 μm thick, about 90 μm thick, about 100 μm thick, or any ranges therebetween.

The plating layer on the stainless steel tape may have a thickness from about 100 nm to about 10 μm. For example, in some embodiments, the thickness is about 100 nm, about 200 nm, about 300 nm, about 400 nm, about 500 nm, about 600 nm, about 700 nm, about 800 nm, about 900 nm, about 1 μm, about 1.1 μm, about 1.2 μm, about 1.3 μm, about 1.4 μm, about 1.5 μm, about 1.6 μm, about 1.7 μm, about 1.8 μm, about 1.9 μm, about 2 μm, about 3 μm, about 4 μm, about 5 μm, about 6 μm, about 7 μm, about 8 μm, about 9 μm, about 10 μm, or any ranges therebetween.

In some embodiments, the stainless steel tape is about 50 μm thick, and the nickel or copper plating is about 1 μm thick.

The coils may be made using various techniques. In some embodiments, a method of making a coil for a superconducting magnet includes the following steps: (i) plating a stainless steel tape with nickel or copper to form a plated stainless steel tape; (ii) positioning the plated stainless steel tape between two REBCO superconducting tapes; and (iii) winding the two REBCO superconducting tapes and the stainless steel tape into a coil. In some embodiments, the plating layer is applied to the stainless steel tape using conventional electroplating techniques.

Figure 16:
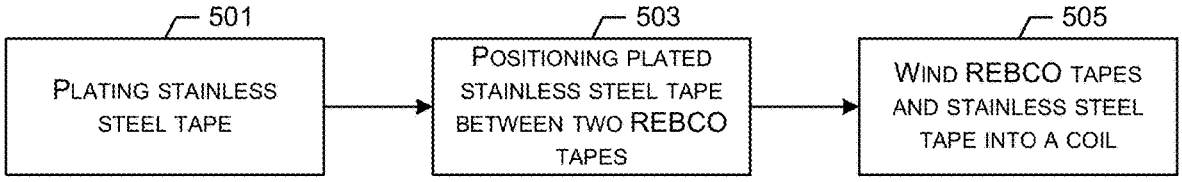
FIG. 16 is a process flow diagram of a method of making a coil for a superconducting magnet, according to some embodiments of the present disclosure.

FIG. 16 is a flow diagram of a method for making the tape structure shown in FIG. 13. This method includes a first step 501 of plating a stainless steel tape, a second step 503 of positioning the plated stainless steel tape between two REBCO superconducting tapes, and a third step 505 of winding the REBCO tapes and stainless steel tape into a coil.

In some embodiments, the modified tape has a turn-to-turn contact resistivity ($R_c$) which is at least about 10 times higher than that of a comparative REBCO superconducting tape without a stainless steel interlayer, for example at least about 10 times higher, at least about 20 times higher, at least about 30 times higher, at least about 40 times higher, at least about 50 times higher, at least about 60 times higher, at least about 70 times higher, at least about 80 times higher, at least about 90 times higher, at least about 100 times higher, at least about 110 times higher, at least about 120 times higher, at least about 130 times higher, at least about 140 times higher, at least about 150 times higher, or any ranges therebetween.

In some embodiments, the modified tape has a turn-to-turn contact resistivity ($R_c$) which is at least about 10 times lower than that of a comparative REBCO tape assembly without nickel or copper plating, for example at least about 10 times lower, at least about 20 times lower, at least about 30 times lower, at least about 40 times lower, at least about 50 times lower, at least about 60 times lower, at least about 70 times lower, at least about 80 times lower, at least about 90 times lower, at least about 100 times lower, at least about 110 times lower, at least about 120 times lower, at least about 130 times lower, at least about 140 times lower, at least about 150 times lower, or any ranges therebetween.

EXAMPLES

In each of the examples described below, the samples used were REBCO conductors made by SuperPower (SCS4050AP) and SuNAM. The SuperPower conductors were 4 mm wide with overall thickness of 95 μm, including 20 μm thick layer of copper stabilizer formed on each side by electroplating. The nominal critical current in self-field at 77 K was 80 A. The residual resistivity ratio of the copper stabilizer layer was measured on similar SuperPower conductors to be about 50. The Examples below used SuperPower SCS4050AP samples unless otherwise stated. The SuNAM conductor was 4 mm wide with overall thickness of 135 μm which includes 30 μm laminated copper stabilizer. The nominal critical current in self-field at 77 K was 105 A. One SuNAM sample included 1 μm stainless steel cladding.

$R_c$ between two SuperPower REBCO samples as a function of temperature and contact pressure has previously been described in the art. Since a practical superconducting magnet typically experiences a few thousand charge-discharge cycles in its lifetime, these examples measure the effect of large number of pressure cycles on $R_c$. Moreover, we performed many experiments in order to develop a technology to control $R_c$. Here we present the effects on $R_c$ by a thin layer of metal deposited on REBCO, various metallic interlayers, and oxidation of REBCO tape.

Example 1: Thin Film Coating and Surface Oxidation

In order to control $R_c$, various kinds of surface coatings were made. The surface coating methods chosen for this experiment are of relatively low cost, and easy to scale up to high volume production.

First, Cr, Ni and Ni—P films were deposited on REBCO conductor directly. Cr film was electroplated on REBCO samples using an electrolyte made with 200 ml of deionized water, 45 g of $Cr_2O_3$, and 0.45 g of sulfuric acid. Ni film was electroplated using a commercial nickel plating solution available from Caswell Inc. USA. Several samples were plated with Ni—P on Ni plated REBCO using a commercial electroless Ni—P plating solution available from Caswell Inc. USA. Ni—P with 5-7% of phosphorus is a high resistivity material with high hardness and good wear resistance. Without intending to be bound by any particular theory, it was believed that all these properties would potentially lead to high contact resistance. All these plating processes resulted in dense, uniform, and adherent metallic coatings.

In addition, Ni and Cu were plated on 316 stainless steel tape, which was then used as an interlayer between two REBCO tapes. For Cu electroplating, a $CuSO_4$ solution was used. The detailed electrolytes and other conditions used for these plating processes are summarized in Table 1.

TABLE 1

REBCO Coating Methods

| Coating | Electrolyte | T (° C.) | Current density (A/dm$^2$) | Growth rate (μm/min) |
|---|---|---|---|---|
| Ni | Caswell Ni | 40 | 1 | 0.12 |
| Ni—P | Caswell electroless Ni—P | 90 | — | 0.5 |
| Cr | $Cr_2O_3$:$H_2SO_4$:$H_2O$ = 45:200:0.45 | 22 | 2.5 | 0.03 |
| Cu on SS | $CuSO_4$—$5H_2O$:$H_2O$ = 7:250 (add $H_2SO_4$ until pH = 1) | 22 | 0.3 | 0.05 |

Figure 1:
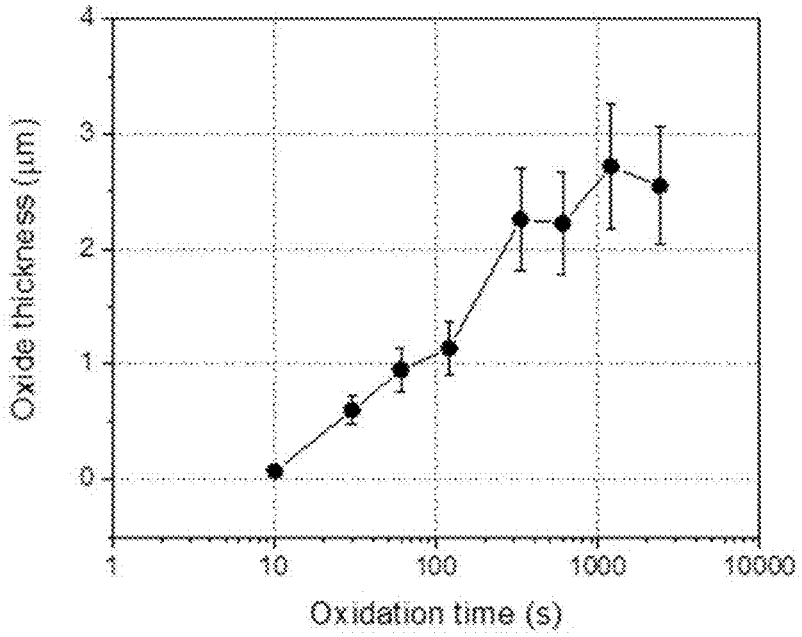
FIG. 1 is a graph which depicts CuO layer thickness versus Ebonol® C oxidation time in accordance with an embodiment of the present disclosure.

In addition, experiments with oxidation of the REBCO surface were conducted. In the oxidation experiments, Ebonol® C, a mixture of sodium hydroxide and sodium chromate were dissolved in deionized water at a weight ratio of Ebonol® C:water=18:80. The REBCO surface was oxidized in Ebonol® C solution at 98° C. for various times. The thicknesses of the oxide layer on the copper strips were measured by weight loss after removing the oxide layer by a solution of HCl:$H_2O$=1:10, and assuming the density of the oxide is 6.31 g/cc for CuO. As shown in FIG. 1, the oxide thickness increases almost linearly with logarithm of time. Ebonol® C concentration was about 18 wt. %, and the temperature was 98° C. in this figure. Depending on the thickness of oxides, the color of the oxidized REBCO surface changed from dark brown after 10 seconds to black after 30 seconds.

Example 2: Transverse Load Cycling and $R_c$ Measurement at Cryogenic Temperatures For $R_c$ measurement, a probe as described in Lu J et al., 2017 Supercond. Sci. Technol. 30 045005 was modified to be fit a Material Test System (MTS) tensile machine which enabled fast load cycling at a rate up to 10 Hz at 77 K or 4.2 K. A 25 mm long lap contact in a REBCO-to-Substrate configuration was placed on a flat G-10 bottom plate. An alignment tool was used to carefully align two REBCO tapes where load cycles of 2.5-25 MPa were applied. $R_c$ was measured during load cycling by applying +/−1.00 A current from a Keithley 2400 bipolar DC current source, and measuring voltage with a Keithley 2010 digital multimeter. The error for all $R_c$ measurements was estimated to be less than 0.1 μΩ-cm$^2$.

As would be understood by one of skill in the art, surface conditions such as slight oxidation or other contamination, as well as the roughness have a significant effect on contact resistance. Since the surface condition of a commercial REBCO conductor is usually not specified, it is expected that $R_c$ from different manufacturers and different production batches varies widely. This variation was investigated by measuring $R_c$ of REBCO with different surface conditions at 25 MPa contact pressure at 77 K. As shown in Table 2 below, $R_c$ varied drastically from sample to sample.

TABLE 2

$R_c$ of samples with various surface conditions

| Sample ID | Surface | Number of samples | $R_c$ at 25 MPa (μΩ-cm$^2$) |
|---|---|---|---|
| SuNAM | Ethanol wiped | 2 | 5.9-7.5 |
| SuperPower-1 | Ethanol wiped, Beginning of the spool | 13 | 16-58 |
| SuperPower-2 | Ethanol wiped, End of the spool | 7 | 47-180 |
| SuperPower-3 | Ethanol wiped then finger handled | 1 | 100 |
| SuperPower-4 | Scotch-brite wiped | 5 | 0.8-7.3 |
| SuperPower-5 | HCl etched | 6 | 3.4-22 |

A systematic difference in $R_c$ between SuperPower and SuNAM conductors was observed. Without intending to be bound by any particular theory, it is believed this difference might be contributed to their respective surface roughness. Specifically, it is believed that these conductors have varied surface roughness because SuperPower conductors have rough finishing with increased thickness at the center and the edges, while SuNAM conductor has a smooth and shiny finishing with relatively uniform thickness. After slightly polishing the SuperPower conductors' surface with an abrasive (Scott-brite) or chemically etching it with a solution of HCl:$H_2O$=1:1, $R_c$ reduced by a factor of about 10. When the conductor surface was handled by ungloved hands, $R_c$ increased by a factor of 2 to 6. When a consistent surface cleaning method was applied, e.g. by wiping with an ethanol soaked tissue, the measured $R_c$ values became much more consistent. Variation along the conductor length of the same piece was also observed.

It has been previously reported that $R_c$ increases with contact load cycling up to 14 cycles of 140 MPa at 77 K. In order to simulate a user magnet with frequent field ramps, the $R_c$ of SuperPower conductors was measured with larger number of load cycles between 2.5 and 25 MPa. This contact pressure range was chosen because it seems to be a reasonable range for radial stresses in a coil. However, the radial stress in a coil, which depends on winding tension, thermal stress, and electromagnetic load during coil's operation, is not uniform and is very difficult to calculate precisely.

Figure 2:
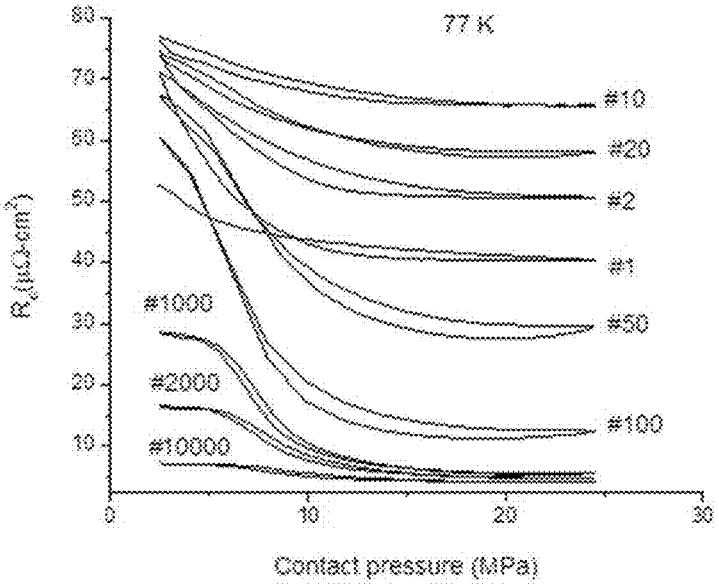
FIG. 2 is a graph which depicts the $R_c$ of as-received SuperPower SCS4050 at 77 K versus contact pressure curves for different number of load cycles in accordance with embodiments of the present disclosure.

FIG. 2 shows a series of curves of $R_c$ vs. contact pressure P measured after different numbers of load cycles at 77 K. Each $R_c$ (P) curve shows expected behavior where $R_c$ decreases with transverse load. It is also evident that $R_c$ increased within the first 10-20 cycles then decreases quickly. After a few hundred cycles, $R_c$ leveled off to a value only about a tenth of its initial value.

Figure 3:
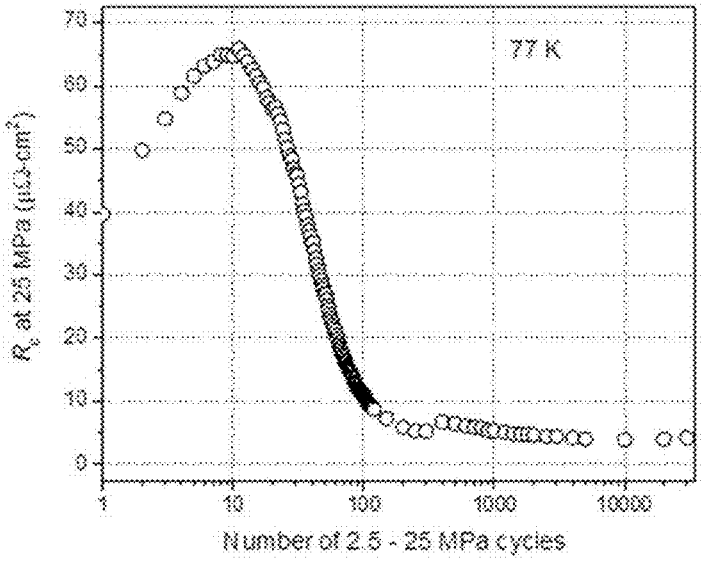
FIG. 3 is a graph which depicts the $R_c$ of as-received SuperPower SCS4050 measured at 25 MPa as a function of number of load cycles in accordance with embodiments of the present disclosure.

This trend is presented more clearly in FIG. 3, where $R_c$ at 25 MPa pressure is plotted against load cycles in a semi-logarithm scale. After only about 200 cycles, $R_c$ decreased to about 4 μΩ-cm$^2$ from the initial value of 40 μΩ-cm$^2$ then leveled off. This experiment was repeated a few times, and similar results were obtained.

Figure 4:
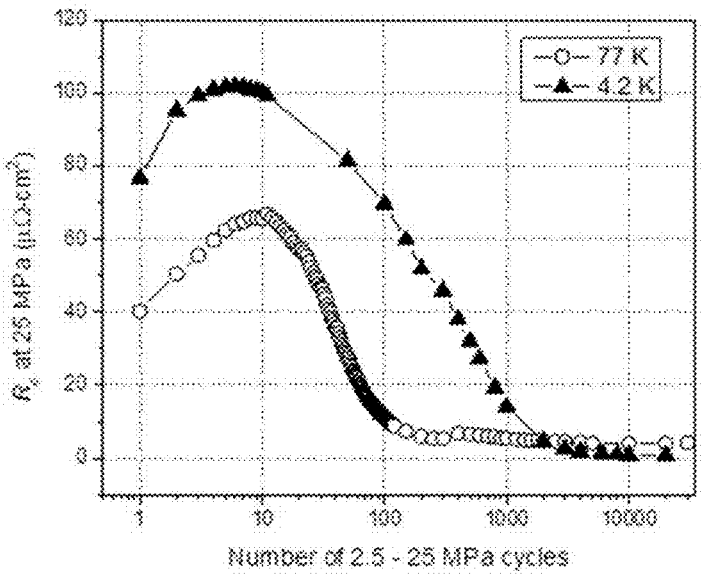
FIG. 4 is a graph which depicts the $R_c$ of as-received SuperPower SCS4050 measured at 25 MPa as a function of number of load cycles at 77 K and 4.2 K in accordance with embodiments of the present disclosure.

To further investigate a high field REBCO magnet operating at 4.2 K, the load cycling effect was studied at 4.2 K as well. The results are presented in FIG. 4 in comparison with the 77 K data. Despite the difference between 77 K and 4.2 K data, which can be partly attributed to the variation from sample to sample, a similar trend was observed. Without intending to be bound by any particular theory, it is believed that the initial higher $R_c$ at 4.2 K was likely due to random variations in surface conditions. The significant decrease in $R_c$ seems to occur after a few hundred cycles, somewhat later than that at 77 K. At the end of 20,000 load cycles at 4.2 K, $R_c$ was only 0.85 μΩ-cm$^2$ which was significantly lower than 4 μΩ-cm$^2$ at 77 K. The lower asymptotic $R_c$ value at 4.2 K is likely due to lower resistivity of copper. After these load cycling experiments, the sample surfaces were examined with a light microscope up to magnification of 1000×. No discernable surface morphology changes were observed.

In order to understand this load cycling effect, the Holm theory of contact resistance was used, where $R_c$ is related to mechanical and electrical properties of the contacting surface by the following equation:

$$R_C = 0.886\rho\sqrt{\frac{HV}{PN}} + \frac{\rho_f dHV}{P} \quad (1)$$

where ρ and $\rho_f$ are resistivity of the contact material (Cu in our case) and the surface contamination film (probably Cu oxides) respectively, HV the Vickers hardness of the contact material, N the number density (in m$^{-2}$) of contact spots, and d the thickness of the oxide film. According to equation (1), under a given contact pressure the harder the contacting material the smaller contact spot radius, therefore higher $R_c$. Without intending to be bound by any particular theory, it is believed that initially the surface cold-work hardened the material and increased its resistivity, both led to higher $R_c$. The cold-working effect reached its saturation at a few tens of cycles. Without intending to be bound by any particular theory, it is believed that the quick decrease in $R_c$ after that might be explained by gradual wear-out of the oxide layer on copper surface. The fact that there is a 10 times difference in $R_c$ between as-received and freshly HCl etched samples seems to be consistent with the existence of a thin resistive oxide layer.

This appreciable load cycling effect has very important implications to NI magnet coil technology, because a magnet in use usually undergoes at least a few thousand charging/discharging cycles in its lifetime. $R_c$ of a magnet coil measured without significant load cycling might considerably underestimate the charging delay time, which, in some cases, could be 10 times longer than its initial value after only a few hundred charging cycles. It should also be noted that during operation the contact pressure in a NI coil is not uniform and depends on the specific magnet design. Therefore, the result from these experiments may not fully represent the situation in a real magnet coil.

Example 3: Thermal Cycling

Figure 5:
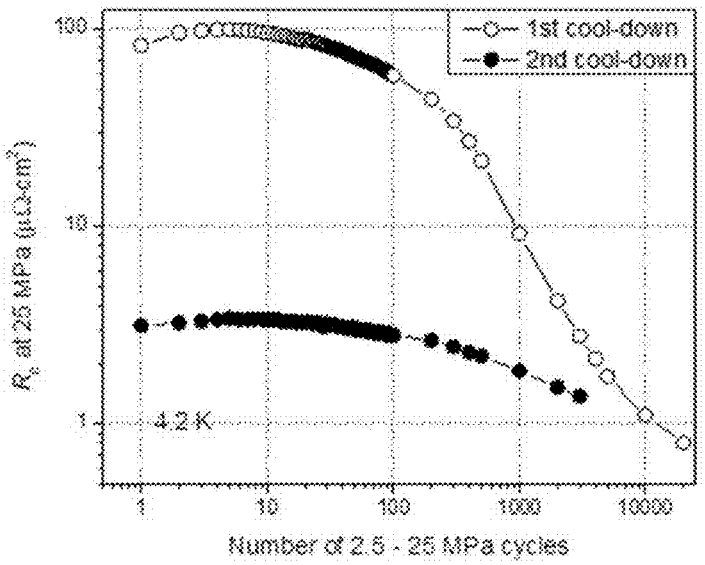
FIG. 5 is a graph which depicts the effect of thermal cycling, specifically $R_c$ vs. number of load cycles at 4.2 K measured after $1^{st}$ and $2^{nd}$ cool-down in accordance with embodiments of the present disclosure.

In its lifetime, a superconducting magnet is usually warmed up to room temperature many times. Therefore, it is very relevant to investigate the effect of thermal cycling on $R_c$. In this example, $R_c$ of a sample of a commercially-available SuperPower conductor was tested for up to 20,000 load cycles at 4.2 K. Then the sample was allowed to naturally warm inside the cryostat overnight under a 2 MPa constant pressure to 273 K. Then the sample was cooled down to 4.2 K again and $R_c$ was measured again. The measured $R_c$ vs. number of cycles for both the first and the second cool-downs are shown in a log-log plot in FIG. 5, wherein during warming up to 273 K, the contact pressure was kept at 2.5 MPa. As shown in the figure, thermal cycling does not reset $R_c$ to its initial value before load cycling. After thermal cycling, $R_c$ only increases moderately from 0.8 μΩ-cm$^2$ to about 3.1 μΩ-cm$^2$, still much less than the initial value of near 100 μΩ-cm$^2$. This suggests that, in a magnet coil, the drastic decrease in $R_c$ due to load cycling cannot be reset by warming the coil up to room temperature.

Example 4: Control of $R_c$

For NI magnet applications, it is highly desirable to control $R_c$ so the coil charging delay time is relatively short without compromising the coil's self-protection ability. Previous studies on load cycling effects suggest that it is also important for $R_c$ to be insensitive to load cycling. To these ends, two approaches were considered. The first approach was to coat the conductor surface with a thin resistive film, so $R_c$ is increased and may be controlled by either the chemical composition or the thickness of the film. The second approach was to wind coil with a resistive co-winding tape, and coat the co-winding tape with various resistive films to control $R_c$. The results of these efforts are presented below.

Figure 6:
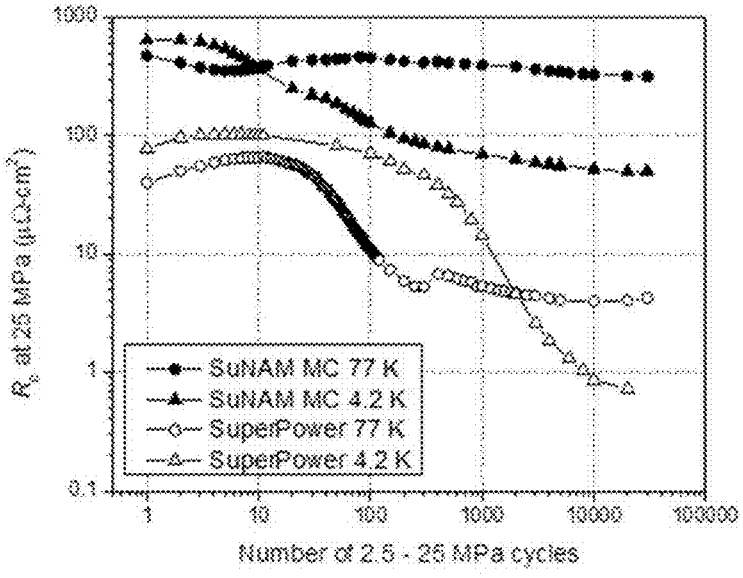
FIG. 6 is a graph which depicts the $R_c$ vs. load cycles of SuNAM metallic cladded sample as compared with SuperPower as-received sample in accordance with embodiments of the present disclosure.

One of the earliest efforts to control $R_c$ was made by the REBCO manufacturer SuNAM. REBCO conductors were coated with up to 1 μm stainless steel cladding (MC-REBCO). The charging delay of the test NI coils using MC-REBCO conductor reduced considerably. Next, the $R_c$ of a SuNAM MC-REBCO was measured as a function of load cycles at both 77 K and 4.2 K. The results are plotted in FIG. 6 together with data from as-received SuperPower samples. Evidently, the SuNAM's MC-REBCO sample has higher $R_c$ than as-received SuperPower sample. Furthermore, $R_c$ does not decrease drastically with load cycles especially at 77 K. While not intending to be bound by any particular theory, it is believed that it might be possible to further controlled $R_c$ by changing the thickness of the stainless steel cladding layer.

Next, metallic layers were deposited on REBCO by electroplating, which is more economical and easier to scale up compared with magnetron sputtering method used by SuNAM. In these experiments, SuperPower conductors were plated with Ni or Cr films of different thicknesses. However, the plated Ni or Cr thin films did not seem to reliably increase $R_c$ as shown in Table 3 below, where $R_c$ under first load at 25 MPa for different surface coatings are listed. Cr plating and the native oxide layer on Cr surface seem to have the potential to significantly increase $R_c$. Further investigation is needed to understand the formation of the native chromium oxides and its effect on $R_c$. On the other hand, the environmental concern of the hex Cr plating makes it a less attractive option.

TABLE 3

$R_c$ of REBCO with different coatings

| Sample | Surface | Number of samples | $R_c$ at 25 MPa (μΩ-cm$^2$) |
|---|---|---|---|
| SuNam | 1 μm stainless steel cladding | 2 | 180, 224 |
| SuperPower | 1 μm Ni plating | 3 | 19-64 |
| SuperPower | 1 μm Cr plating | 2 | 41, 2000 |
| SuperPower | Graphite sprayed | 1 | 180 |

Figure 7:
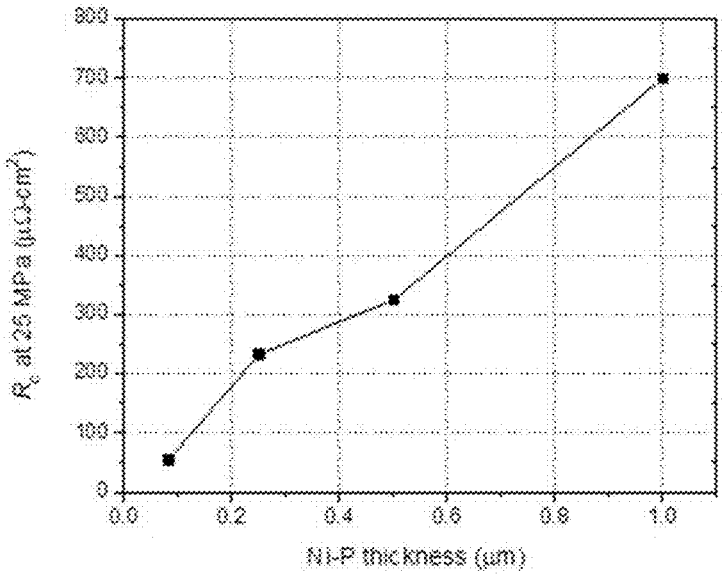
FIG. 7 is a graph which depicts the effect of Ni—P plating, $R_c$ vs. Ni—P thickness, in accordance with embodiments of the present disclosure.
Figure 8:
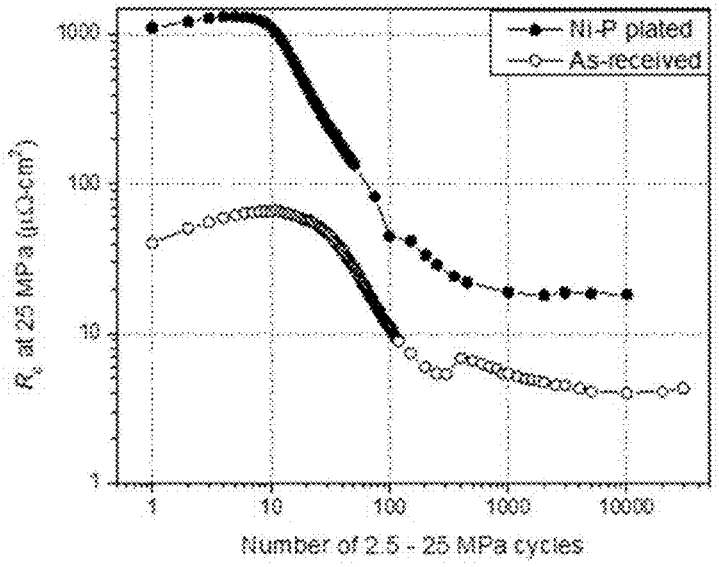
FIG. 8 is another graph which depicts the effect of Ni—P plating, $R_c$ vs load cycles, in accordance with embodiments of the present disclosure.

Ni 5-7 wt % P is a highly resistive and wear and corrosion resistant material that can be plated to metal surfaces by an electroless process. Therefore, in order to increase the $R_c$, Ni—P of various thicknesses was plated on SuperPower samples which was already plated with a 1 μm pure Ni layer. The 77 K $R_c$ measurements on Ni—P plated samples shows a near linear increase in $R_c$ with Ni—P thickness, as shown in FIG. 7. This shows the effect of Ni—P plating, wherein Ni—P was plated on REBCO with a 1 μm pure Ni buffer layer. This demonstrates a certain level of $R_c$ control by varying Ni—P thickness. However, the Ni—P sample seems to be sensitive to load cycling. For FIG. 8, Ni—P was plated on REBCO with a 1 μm pure Ni buffer layer for 1 μm Ni—P plated sample with an as-received sample for comparison. As shown in FIG. 8, after only a few hundred load cycles, $R_c$ of a 1 μm Ni—P plated sample drops down almost two orders of magnitudes and becomes lower that an as-received uncoated sample.

Example 5: Co-Wind Tape and Its Coating

A co-wind including REBCO pancake coil with 316 stainless steel (316 SS) tape was used to create a NI coil. Here, the co-winding 316 SS tape was used as mechanical reinforcement as well as a metallic interlayer to increase $R_c$. The properties of 316 SS co-wound REBCO coils have been analyzed by Noguchi S et al 2017 IEEE Trans. Appl. Supercond. 27 7700505 and experimental results reported in Wang Y et al 2017 IEEE Trans. Appl. Supercond. 27 3700105; Gupta R et al 2016 IEEE Trans. Appl. Supercond. 26 4100705; and Lécrevisse T and Iwasa Y 2016 IEEE Trans. Appl. Supercond. 26 4700405. In order to verify the $R_c$ values reported in these references, we measured $R_c$ of two SuperPower REBCO conductors which has a 50 μm thick 316 SS tape placed in between.

Figure 9:
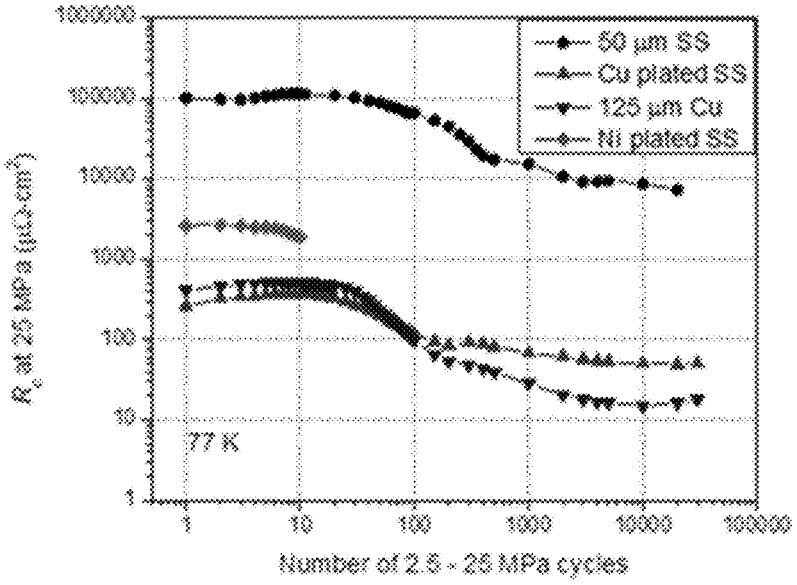
FIG. 9 is a graph which depicts the effect of co-wind tape, $R_c$ vs. load cycles, for REBCO inserted with SS tape, Cu tape, Ni plated SS tape and Cu plated SS tape, in accordance with embodiments of the present disclosure.

As shown in FIG. 9, $R_c$ is in the order of 10,000 to 100,000 μΩ-cm$^2$ which is much higher than ~1000 μΩ-cm$^2$ reported in Wang Y et al 2017 IEEE Trans. Appl. Supercond. 27 3700105, and about 3 orders of magnitude higher than measured without the 316 SS interlayer. Since the resistance of 50 μm SS tape in its thickness direction is only in the order of 1 μΩ-cm$^2$ at 77 K, the high $R_c$ was likely due to the native oxide layer on SS surface as well as its appreciable hardness compared with copper. This is consistent with equation (1) above, where high native oxide resistivity $\rho_f$ and high hardness HV make $R_c$ higher. With such high $R_c$, the self-protection ability of such an NI coil becomes questionable, especially for the coils with large stored energy. So, in an effort to reduce and control such high $R_c$, about 1 μm of pure nickel or copper was plated on the SS tape. As also shown in FIG. 9, these thin films of pure metals on SS tape reduced $R_c$ dramatically. The remarkable effect of these thin films on $R_c$ demonstrates the importance of the native oxide resistivity and contact material hardness. This moderation of $R_c$ by a thin film on SS co-wind tape seems to be a viable option for controlling $R_c$ in a NI magnet coil.

Figure 10:
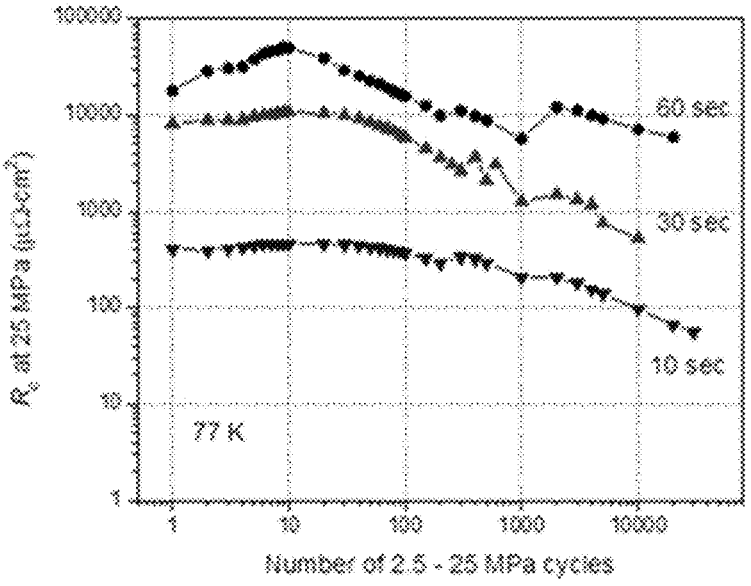
FIG. 10 is a graph which depicts the $R_c$ vs. load cycles for REBCO oxidized by Ebonol® C for 10, 30, and 60 seconds, in accordance with embodiments of the present disclosure.

Surprisingly, the $R_c$ of the 125 μm thick Cu tape between REBCO tapes, as plotted in FIG. 10, is similar to that with the Cu plated SS. This further demonstrates the dominant role surface material play in controlling $R_c$.

Example 6: Surface Treatment by Ebonol® C Oxidation

Figure 11:
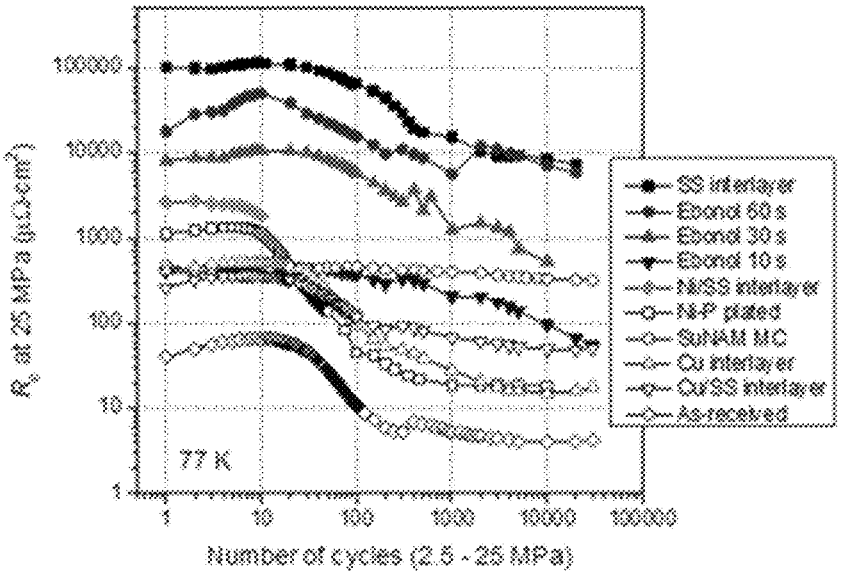
FIG. 11 is a graph which depicts a summary of all the $R_c$ vs load cycle curves measured at 77 K from samples of different surface and interlayer conditions, in accordance with some embodiments of the present disclosure.

Since electroplating pure metals on REBCO seems to have limited potential in controlling $R_c$, as discussed in Examples 1-4 above, an alternative is to deposit a layer of highly resistive material on REBCO, so $R_c$ may be controlled reliably by changing the thickness of the deposited layer. To produce a copper oxide CuO semiconductor layer, we used a commercial copper blacken agent Ebonol® C to oxidize the Cu surface of REBCO tapes and calibrated the oxide thickness as a function of oxidation time (FIG. 1). FIG. 10 shows the $R_c$ as function of load cycle for samples oxidized for 10, 30 and 60 seconds. The $R_c$ of these samples ranges 2 orders of magnitude and are significantly higher than the as-received REBCO. Furthermore, they do not seem to decrease too much with load cycling. Therefore, by controlling the oxidation time, $R_c$ can be easily controlled and be tailored to different NI coil for different applications. This Ebonol® C oxidation process is also economical and easy to be scaled up to have a reel-to-reel surface treatment process which allows industry to manufacture REBCO tape with customized $R_c$ at a low cost. FIG. 11 summarizes all 77 K $R_c$ vs. load cycle curves presented previously. This covers a large varieties of $R_c$ from different surface conditions. Among them, the most controllable cases are the Ebonol® C treated surfaces.

Finally, it should be noted that these $R_c$ measurements were performed on small stamp samples. Although this technique has the advantages of being versatile and able to perform fast measurements under large number of load cycles, and the ability to reveal the underlying physics of the contact resistance, the results of these experiments should be confirmed with a coil test such as those performed in Hahn S et al 2011 IEEE Trans. Appl. Supercond. 21 1592-1595. This is because, for the applications in magnet coils, the contact pressure varies from turn to turn, so the effect of the load cycling cannot be predicted precisely. An $R_c$ test by a small coil, such as could be achieved with a reel-to-reel Ebonol® oxidation system, would bring us one step closer to the real situation in a magnet coil. A reel-to-reel Ebonol® oxidation system would allow oxidation of the surface of long length of REBCO tapes in order to make small coils for $R_c$ tests.

Conclusions from the Examples

The contact resistance $R_c$ between two REBCO tapes was measured at 77 K and 4.2 K under mechanical load between 2.5 and 25 MPa up to 30,000 cycles. It was found that $R_c$ reaches maximum at 10-20 cycles and then decreases. After about a thousand cycles, $R_c$ decreased to about one tenth of its initial value. Thermal cycling by warming the sample from 4.2 K to 273 K under 2.5 MPa pressure and cooling down to 4.2 K again increased $R_c$ slightly, which was still much below its initial value. Both electroplating of Ni, Cr, and Ni—P directly on REBCO and using a Cu or Ni plated SS co-wind tape were able to control $R_c$ to a certain degree. Stainless steel interlayer increases $R_c$ by about three orders of magnitude; while the Cu plated stainless steel interlayer only increases the $R_c$ by one order of magnitude. Controlled REBCO surface oxidation by an Ebonol® C solution results in an easily controlled $R_c$ that covers a wide range by varying oxidation time. This oxidation technique can be easily scaled up to meet the needs of large NI magnet coils.

We claim:

1. A coil for a superconducting magnet consisting of:

a rare earth barium copper oxide (REBCO) superconducting tape; and a thin resistive layer of copper oxide, Cr, Ni, or Ni—P substantially coated onto the REBCO superconducting tape, wherein the coated REBCO superconducting tape is wound into a coil.

2. The coil of claim 1, wherein the thin resistive layer is about 1 μm thick.

3. The coil of claim 1, wherein the coated REBCO superconducting tape has a turn-to-turn contact resistivity ($R_c$) that is at least 10 times higher than that of a REBCO superconducting tape without a thin resistive layer of copper oxide, Cr, Ni, or Ni—P.

4. The coil of claim 1, wherein the coated REBCO superconducting tape has a turn-to-turn contact resistivity ($R_c$) that is at least 100 times higher than that of a REBCO superconducting tape without a thin resistive layer of copper oxide, Cr, Ni, or Ni—P.

5. The coil of claim 1, wherein the coated REBCO superconducting tape has a turn-to-turn contact resistivity ($R_c$) that is at least 1,000 times higher than that of a REBCO superconducting tape without a thin resistive layer of copper oxide, Cr, Ni, or Ni—P.

6. The coil of claim 1, wherein the thin resistive layer comprises copper oxide.

7. The coil of claim 1, wherein the thin resistive layer of copper oxide, Cr, Ni, or Ni—P is substantially coated onto the REBCO superconducting tape by a plating process or by a physical vapor deposition process.

8. A coil for a superconducting magnet consisting of:

at least two REBCO superconducting tapes; and a stainless steel tape interlayer disposed between the at least two REBCO superconducting tapes, wherein the stainless steel tape comprises a plating layer of nickel or copper, and wherein the at least two REBCO superconducting tapes together with the stainless steel tape interlayer are wound into a coil.

9. The coil of claim 8, wherein the stainless steel tape is 50 μm thick.

10. The coil of claim 8, wherein the plating layer is 1 μm thick.

11. The coil of claim 8, wherein the two REBCO superconducting tapes with the interlayer have a turn-to-turn contact resistivity ($R_c$) that is at least 10 times higher than that of REBCO superconducting tapes without a stainless steel tape interlayer.

12. The coil of claim 8, wherein the two REBCO superconducting tapes with the interlayer have a turn-to-turn contact resistivity ($R_c$) that is at least 100 times higher than that of REBCO superconducting tapes without a stainless steel tape interlayer.

13. The coil of claim 8, wherein the two REBCO superconducting tapes with the interlayer have a turn-to-turn contact resistivity ($R_c$) that is at least 10 times lower than that of REBCO superconducting tapes without nickel or copper plating on a stainless steel tape interlayer.

14. The coil of claim 8, wherein the two REBCO superconducting tapes with the interlayer have a turn-to-turn contact resistivity ($R_c$) that is at least 100 times lower than that of a REBCO superconducting tapes without nickel or copper plating on a stainless steel tape interlayer.

15. A method of making a coil for a superconducting magnet, the method consisting of:

providing a REBCO superconducting tape;

forming a thin resistive layer of copper oxide, Cr, Ni, or Ni—P substantially coating the REBCO superconducting tape; and then winding the coated REBCO tape into a coil.

16. The method of claim 15, wherein the thin resistive layer is formed on the REBCO superconducting tape by a plating process or by a physical vapor deposition process.

17. The method of claim 15, wherein the thin resistive layer is formed on the REBCO superconducting tape by a plating process in which the REBCO superconducting tape is contacted with an electrolyte solution selected from an Ebonol C solution, a Caswell nickel solution, a Caswell nickel-phosphorous solution, a $Cr_2O_3$ and $H_2SO_4$ aqueous solution, and a $CuSO_4$ aqueous solution.

18. The method of claim 15, wherein the thin resistive layer of copper oxide, Cr, Ni, or Ni—P is about 1 μm thick.

19. A method of making a coil for a superconducting magnet, the method consisting of:

plating a stainless steel tape with nickel or copper to form a plated stainless steel tape;

positioning the plated stainless steel tape between two REBCO superconducting tapes; and winding the two REBCO superconducting tapes and the stainless steel tape into a coil with no additional insulation disposed between the two REBCO superconducting tapes or between a REBCO superconducting tape and the plated stainless steel tape.

20. The method of claim 19, wherein plating the stainless steel tape comprises an electroplating process.

21. The method of claim 19, wherein the stainless steel tape is about 50 μm thick.

22. The method of claim 21, wherein the nickel or copper plating is about 1 μm thick.

23. A superconducting magnet comprising two or more of the coils according to claim 1.

24. A superconducting magnet comprising two or more of the coils according to claim 8.

25. A coil for a superconducting magnet consisting of:

a rare earth barium copper oxide (REBCO) superconducting tape;

a thin resistive layer of copper oxide, Cr, Ni, or Ni—P substantially coated onto the REBCO superconducting tape; and a stainless steel layer attached to the REBCO superconducting tape, wherein the coated REBCO superconducting tape is wound into a coil.

26. The coil of claim 25, wherein the coated REBCO superconducting tape has a turn-to-turn contact resistivity ($R_c$) that is at least 10 times higher than that of a REBCO superconducting tape without a thin resistive layer of copper oxide, Cr, Ni, or Ni—P.

* * * * *